US005647421A

United States Patent [19]

Hoffmann et al.

[11] Patent Number: 5,647,421

[45] Date of Patent: Jul. 15, 1997

[54] DUAL SHAPE ASSEMBLY

[75] Inventors: Brian M. Hoffmann, Louisville; Gerald W. Huntley, Monument; Joseph E. Kovach, Thornton, all of Colo.

[73] Assignee: Hunter Douglas Inc., Upper Saddle River, N.J.

[21] Appl. No.: 466,099

[22] Filed: Jun. 6, 1995

[51] Int. Cl.[6] ..... A47H 1/00

[52] U.S. Cl. ..... 160/120; 160/23.1; 160/241; 160/291

[58] Field of Search ..... 160/120, 121.1, 160/122, 241, 321, 23.1, 291, 323.1

[56] References Cited

U.S. PATENT DOCUMENTS

| | | | |
|---|---|---|---|
| 824,930 | 7/1906 | Hopkins | 160/291 |
| 2,503,101 | 4/1950 | Drury | 160/120 |
| 3,007,342 | 11/1961 | Wardlaw | 160/291 |
| 3,063,495 | 11/1962 | Petrick . | |
| 4,020,889 | 5/1977 | Karoll | 160/120 |
| 4,237,956 | 12/1980 | Sivin et al. | 160/120 |
| 4,372,432 | 2/1983 | Waine et al. . | |
| 4,433,765 | 2/1984 | Rude et al. . | |
| 4,610,293 | 9/1986 | Weiblen | 160/120 |

FOREIGN PATENT DOCUMENTS

| | | |
|---|---|---|
| 1557062 | 2/1969 | France . |
| 1093527 | 11/1960 | Germany . |
| 2182738 | 5/1987 | United Kingdom . |

*Primary Examiner*—Kenneth J. Dorner
*Assistant Examiner*—Bruce A. Lev
*Attorney, Agent, or Firm*—Gary M. Polumbus; Dorsey & Whitney LLP

[57] ABSTRACT

A double panel window shade is formed by shade panels wound on inner and outer coaxial rollers. The inner roller includes a shaft secured at each end and journaled in mounting brackets at each end of the inner roller. The outer roller includes end plates journaled on the inner roller shafts. The outer roller defines a slot for receiving and passing the inner shade when said outer shade is fully unrolled from the outer roller. Each shade panel includes a bottom rail. A pull cord is provided for raising and lowering the shades by rotating the rollers. The pull cord is operatively connected to the inner roller by a dual direction spring clutch. The rollers are formed by a pair of roller tubes aligned one inside the other and each having a central axis, the axis of rotation of each tube being the central axis of the inner tube, and the central axis of the outer tube being spaced from its axis of rotation.

9 Claims, 10 Drawing Sheets

20
31
9
29
30
9
31
32
28
21
24
25
22
26

6
31
29
4
6
20
31
5
28
21
30

4
5

20
21
58
60
61
62
29
59
71
66
69
70
68
40
76
78
54
56
52
55
57
56
80
82
84
64
65
34
38
41
24
42
25
85
96
95
94
92
74
72
37
86
22
89
88
90
105
30
90
26
39
48
44
51
79
84
75
81
46
48
45
50
82
28
49
102
104
31
100
102
101
31
100
101

DUAL SHAPE ASSEMBLY

BACKGROUND OF THE INVENTION

1. Field of the Invention

The present invention relates to extendable shades and screens and more particularly to dual window shades, one serving as a decorative curtain and the other for light and privacy control.

2. Description of the Prior Art

A roller mounted window shade with a dual acting clutch and a pull cord or chain actuator is shown in U.S. Pat. No. 4,372,432. A dual acting clutch mechanism is shown in U.S. Pat. No. 4,433,765.

OBJECTS OF THE INVENTION

The principal object of the present invention is to provide an improved dual shade assembly which is compact, easily operated and provides an attractive light and privacy control window covering.

Another object is to provide an improved dual shade assembly of the foregoing character in which the shades are interactive to provide both decorative and light control features as well as convenience of operation with a single pull cord.

A further object of the present invention is to provide a shade assembly of the foregoing character which is suitable for use with a wide variety of fabrics and sheet panels which may be selectively adopted to provide unique and decorative light control window coverings.

Other objects and advantages will become apparent as the following description proceeds taken in conjunction with the accompanying drawings.

SUMMARY OF THE INVENTION

In accordance with the foregoing objects, the present invention is embodied in a double panel window shade comprising inner and outer coaxial rollers each supporting a shade panel. The outermost roller supports a sheer or decorative panel while the inner roller supports a light control and privacy panel. The inner roller is mounted to the window frame by end plates supporting a valance in turn mounted on support brackets secured to the frame. The inner roller in the preferred embodiment includes a spring clutch and pull cord assembly for raising and lowering the shade while precluding manual or gravity operation. The outer roller surrounds the inner roller and is journaled thereon, both rollers rotating about a single axis. The center axis of the outer roller, however, is spaced from its axis of rotation and positioned such that when the outer decorative shade is fully extended a moment arm prevents the outer roller from rolling up as the inner roller is operated. A slot in the outer roller passes the inner or rear shade and the bottom rail on the inner shade engages the outer roller when the inner shade is fully wound thereby tying the two rollers together so that the outer roller can be wound to roll up or down the shade thereon.

The shade assembly embodying the invention provides a roll-up and roll-down sheer curtain for decorative and light modulation while an inner or rear shade provides an opaque or translucent curtain for privacy and light control. The assembly is a dual roller assembly so that the outer sheer shade is lowered before lowering the inner light control shade, and the inner shade is raised before raising the outer shade. The outer shade is a decorative sheer shade or translucent material while the inner shade is opaque or more densely translucent for light control and privacy purposes.

DESCRIPTION OF THE PREFERRED EMBODIMENT

Figure 1:
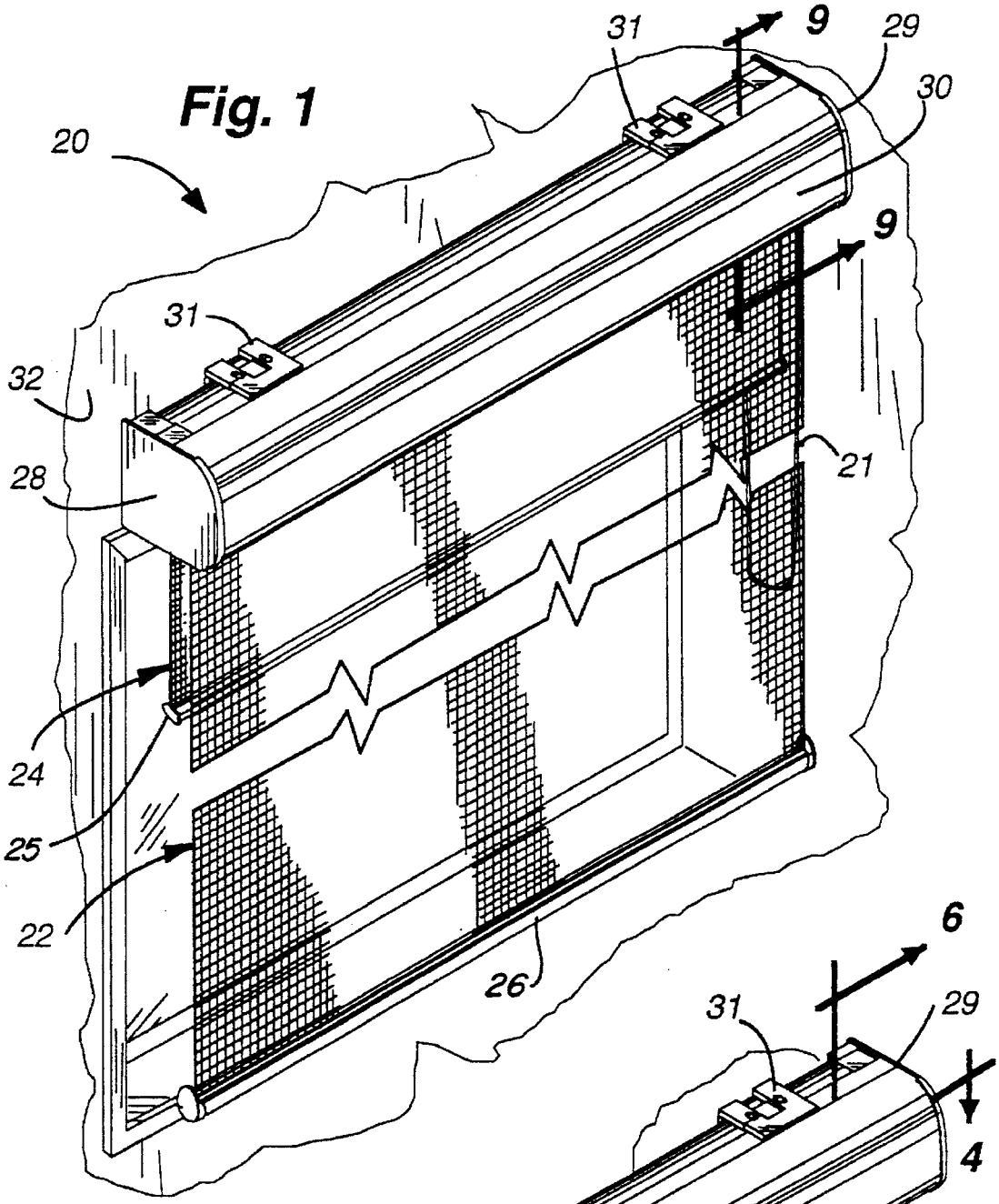
FIG. 1 is a perspective view of a dual shade assembly embodying the present invention mounted on a window frame.
Figure 2:
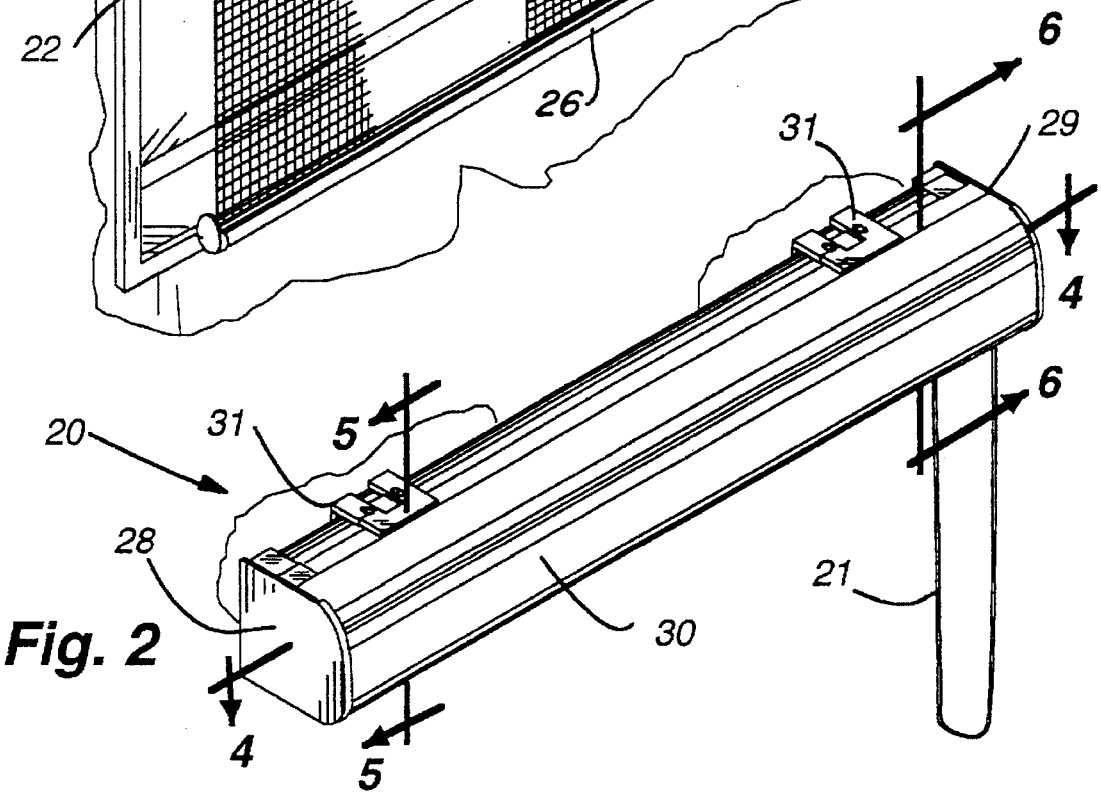
FIG. 2 is a perspective view of the roller assembly shown in FIG. 1 but with the shades fully rolled and wound on the rollers.

The present invention is embodied in a dual roller double acting friction clutch driven shade assembly 20 actuated by a single pull cord 21 to raise or lower an outer or front decorative or sheer shade 22 and an inner or rear light control and privacy shade 24 (FIGS. 1 and 2). Each shade 22, 24 is provided with a bottom rail 26, 25 respectively which is of sufficient weight to hold its respective shade in a downwardly extended unrolled position and maintain a tension on the shade during rolling and unrolling. The shades and rollers are mounted between end plates 28, 29 mounted at each end of a housing or valance 30 supported by mounting brackets 31 secured to an architectural opening such as a window frame or adjoining wall 32.

Figure 3:
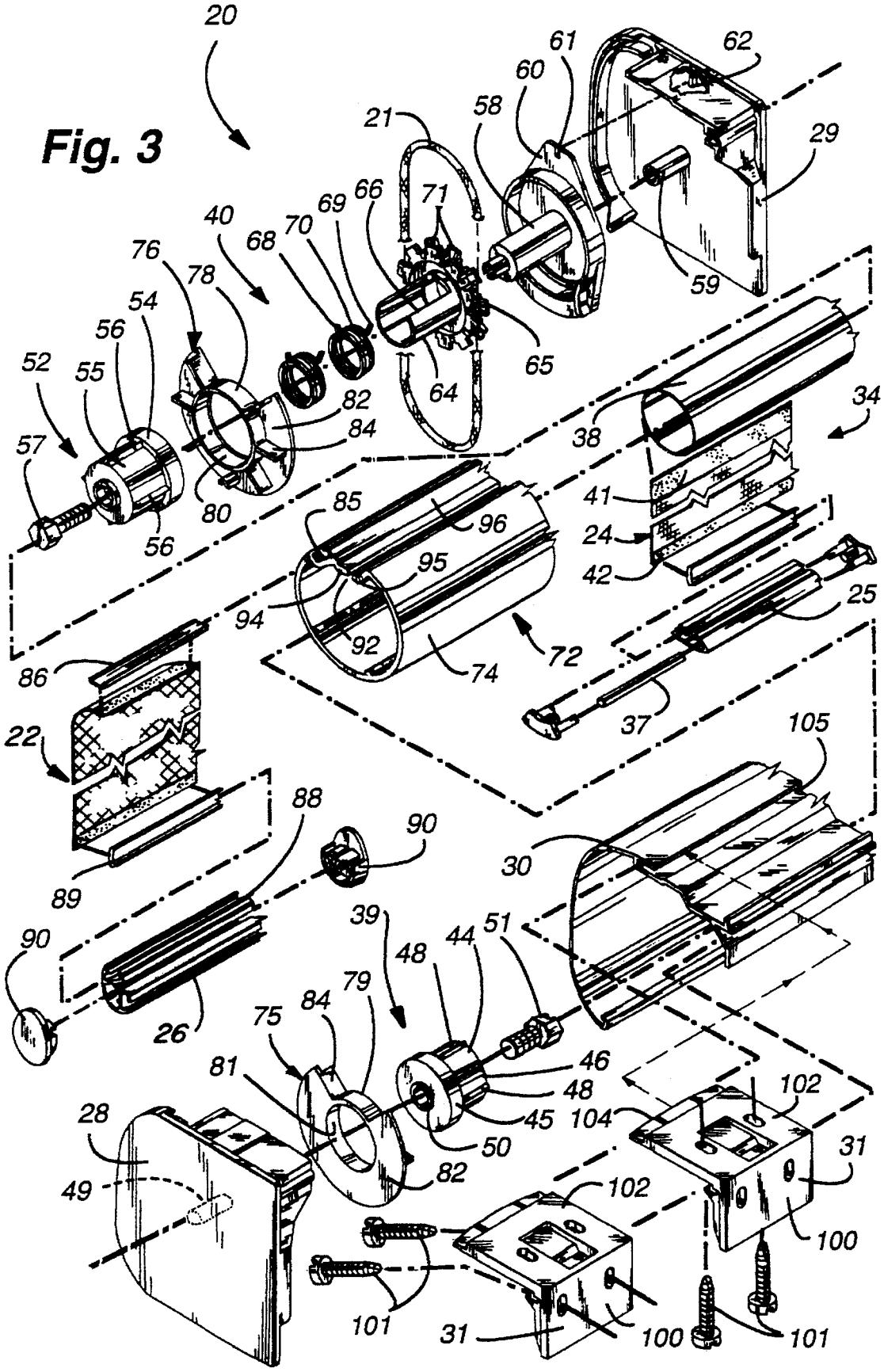
FIG. 3 is an exploded view of the roller shade assembly.
Figure 4:
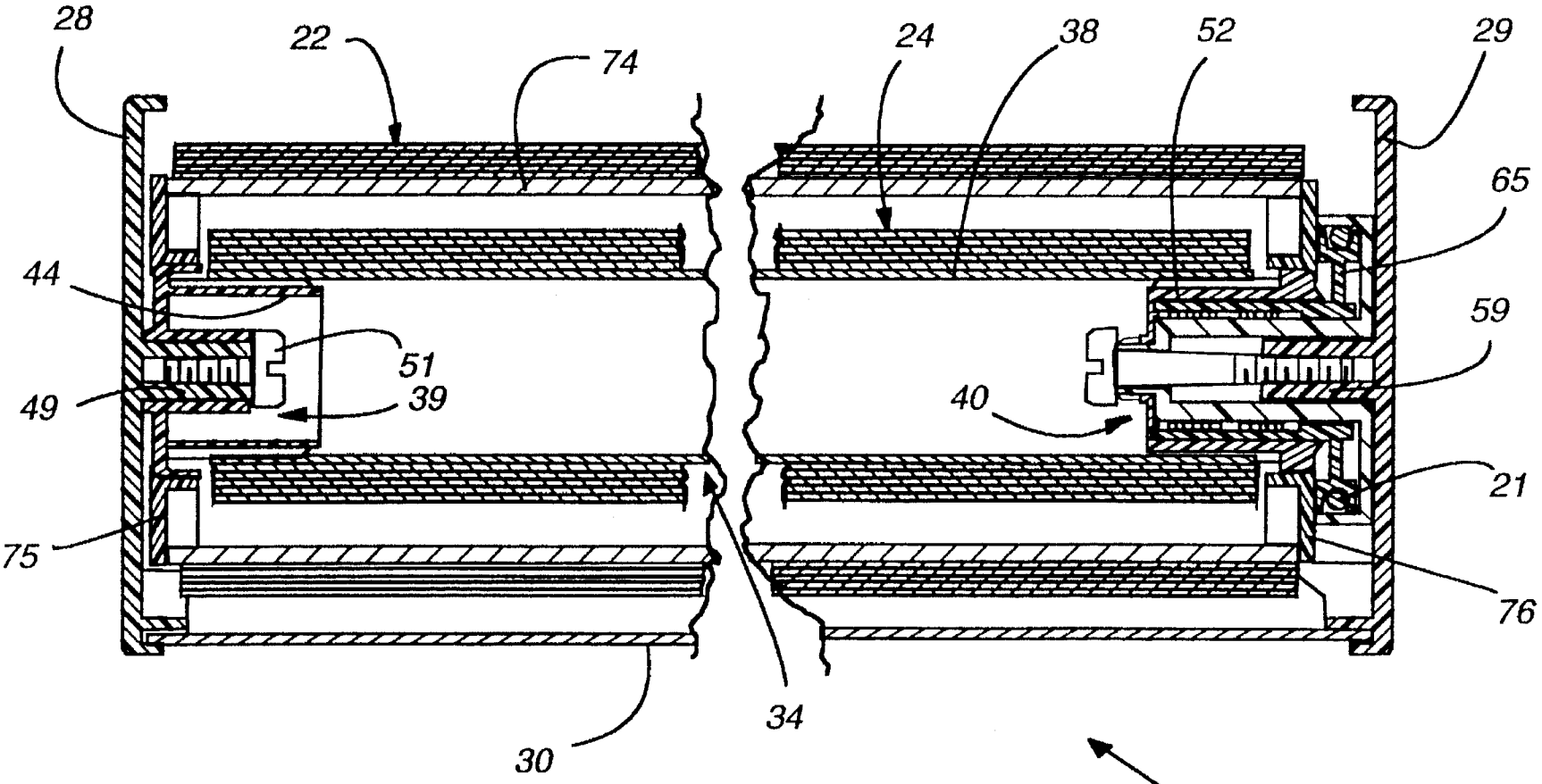
FIG. 4 is a section view taken substantially in the horizontal plane of line 4—4 on FIG. 2.
Figure 5:
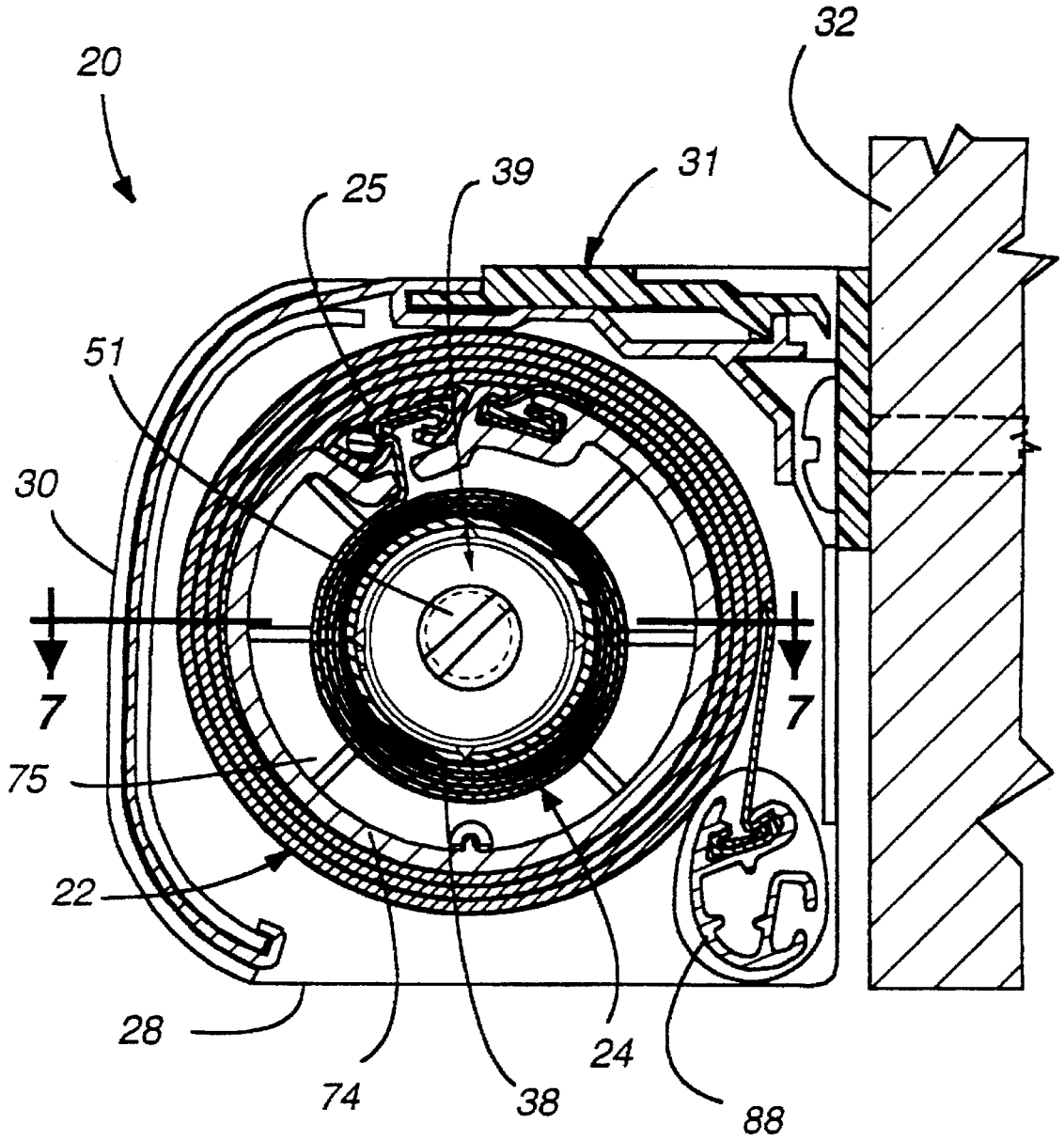
FIG. 5 is an enlarged section view taken substantially in the transverse vertical plane of line 5—5 on FIG. 2.

The inner or rear shade 24 is wound on an inner roller 34 journaled between the end plates 28, 29 (FIGS. 3 and 4). The inner roller 34 is formed by a roller tube 38 having a journal assembly 39 mounted at one end and a dual acting clutch and pull cord assembly 40 mounted at the other end. The inner or rear shade is secured along one transverse edge 41 in any suitable manner to the roller tube 38, and when unrolled, depends from the roller 38 terminating in an opposite transverse bottom edge 42 to which is secured in any appropriate manner a bottom rail 25. The length and width of the shade 24 is determined by the length and width of the window opening to be covered. The shade is formed of any appropriate light and privacy control material, whether opaque or translucent, and whether fabric, plastic or any other suitable material. The shade panel may be attached to the inner roller 38 in any appropriate manner, such as by an adhesive, groove and insert strip or the like. Likewise, the shade panel may be attached at its bottom edge to the bottom rail by adhesive, or by a groove and insert attachment construction. A weight rod 37 inserted in the bottom rail adds mass to the rail and can be adjustably positioned to eliminate skew in the shade panel.

Figure 7:
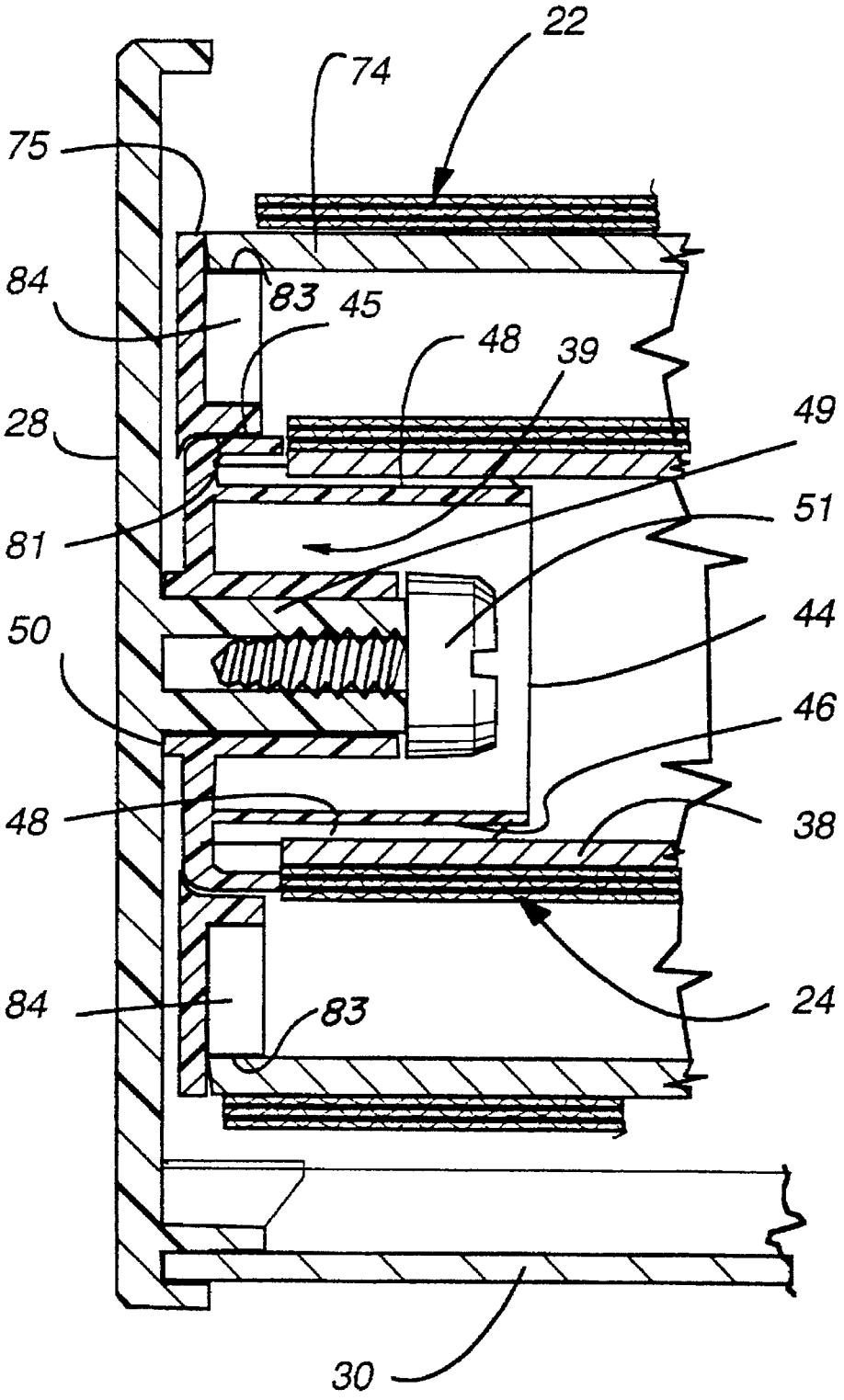
FIG. 7 is an enlarged section view of the left hand end of the roller assembly shown in FIG. 4.

For rotatably mounting one end of the inner roller tube 38 to an adjacent mounting plate 28, the journal assembly 39, as shown in FIGS. 3, 4 and 7, includes a cylindrical bearing sleeve 44 defining an outer cylindrical bearing surface 45 with an integral insert plug portion 46 adapted to be inserted into the end of the inner roller tube 38 and held tightly therein by frictional engagement between external ribs 48 on the plug and the inner wall surface of the tube 38. A stub shaft 49 extends outwardly from the inner surface of the end plate 28 and is journaled in a sleeve bearing 50 defined and integrally formed in the end of the insert plug 46 for rotatably supporting the inner roller tube on the adjoining end plate 28. The sleeve bearing 50 may be rotatably held on the stub shaft 49 by a screw or like fastener 51 threadably engaged with the end of the stub shaft 49.

Figure 8:
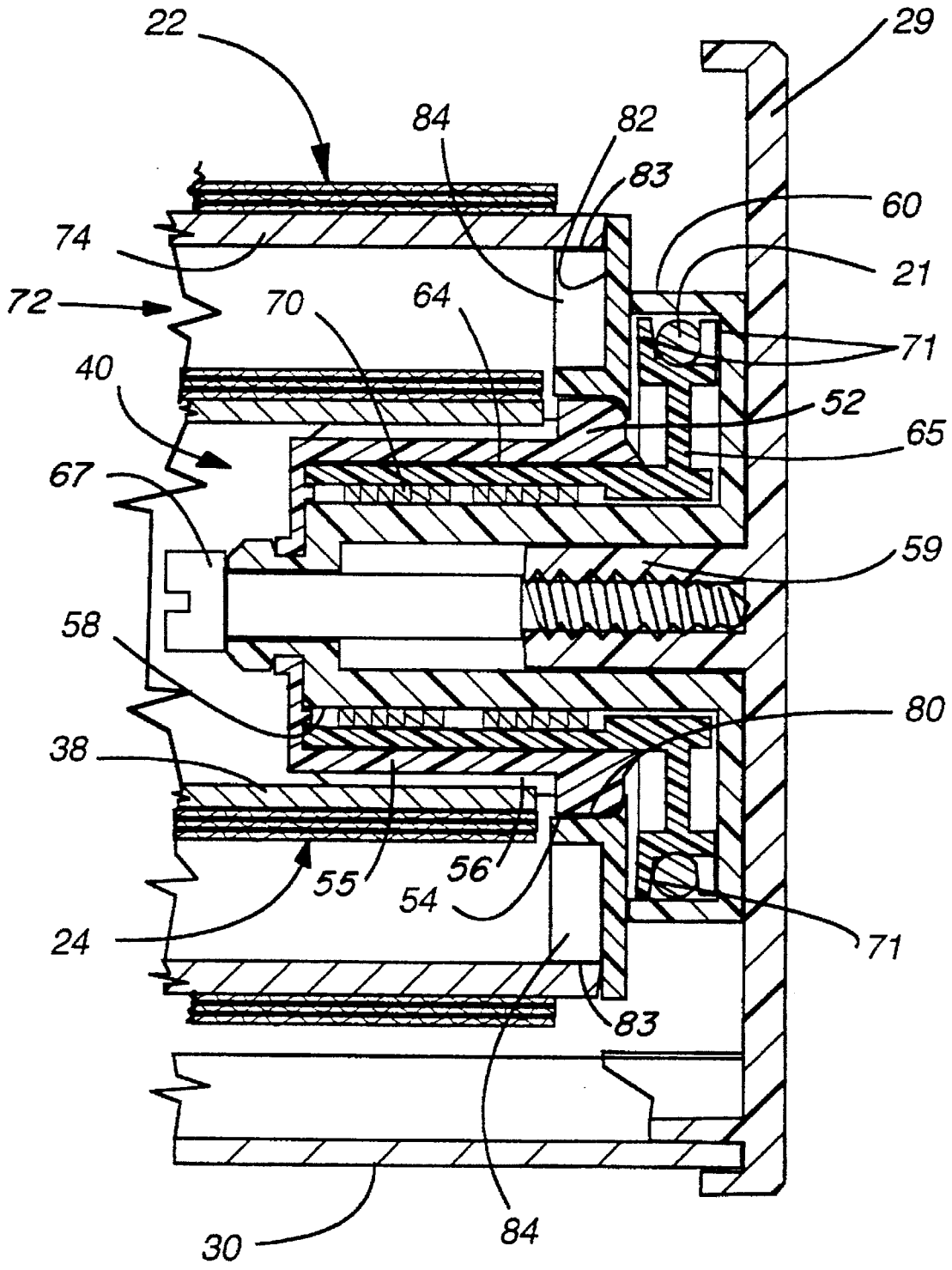
FIG. 8 is an enlarged partial section view of the right hand portion of the roller assembly shown in FIG. 4.

At its opposite end the inner roller tube 38 is engaged with the dual acting spring clutch and pull cord assembly 40 which supports the roller tube on the adjoining end plate 29, as shown in FIGS. 3, 4 and 8. The clutch assembly 40 is formed by a clutch housing 52 defining an outer cylindrical bearing surface 54 and having an insert sleeve plug 55 integrally formed thereon for insertion into the end of the roller tube 38. The sleeve plug 55 is held tightly in the roller tube by engagement between friction ribs 56 thereon and the inner surface of the tube 38.

The clutch assembly 40 includes a clutch cylinder sleeve 58 adapted to receive a stub shaft 59 on the adjacent end plate 29 for mounting the clutch assembly and tube thereon. For keying the clutch assembly to the end plate 29, a clutch assembly end plate 60 integrally formed with the clutch cylinder 58 sleeve defines an aperture or slot 61 which engages a pin or key 62 on the end plate 29 (FIG. 3).

The clutch assembly 40 conventionally includes a clutch shaft or sleeve 58 on which is journaled a clutch sleeve 64 having a pull cord wheel 65 thereon. The sleeve 64 defines an axially extending slot 66 for receiving and engaging the tangs 68, 69 of a helical clutch spring 70 mounted on the clutch sleeve 64. The clutch housing sleeve 52 receives and houses the clutch shaft or cylinder sleeve 58, clutch sleeve 64 and dual clutch spring 70. The clutch assembly is secured to the end plate 29 by a screw fastener 67 extending through the clutch into threaded engagement with the mounting shaft 59.

For receiving and frictionally engaging the pull cord 21, the pull cord wheel 65 defines a plurality of slotted teeth 71. By pulling on the pull cord 21 in one direction, the cord wheel 65 is rotated and the inner or rear shade is unwound and lowered. Pulling on the cord 21 in the opposite direction raises the inner shade by winding it on the roller tube 38. The friction clutch prevents the shade from being wound or unwound without using the cord. The inner shade and clutch assembly is described in further detail in U.S. Pat. No. 4,372,432.

The outer or front shade 22 is wound on an outer roller assembly 72 which surrounds and encloses the inner roller tube 38. The outer roller assembly 72 is formed by a roller tube 74 surrounding the inner roller tube 38 and is provided with end plates 75, 76 (FIG. 4) defining cylindrical bearings 78, 79 defining internal bearing surfaces 80, 81 respectively (FIGS. 7, 8) journaled on the outer bearing surfaces 45, 54 of the inner roller tube journal assembly 39 and clutch assembly 40. The end plates 75, 76 further define external flanges 82 with supporting ribs 84, the outer edges 83 of which frictionally engage the inner surface of the outer tube 74 to secure the end plates 75, 76 tightly thereto.

Figure 6:
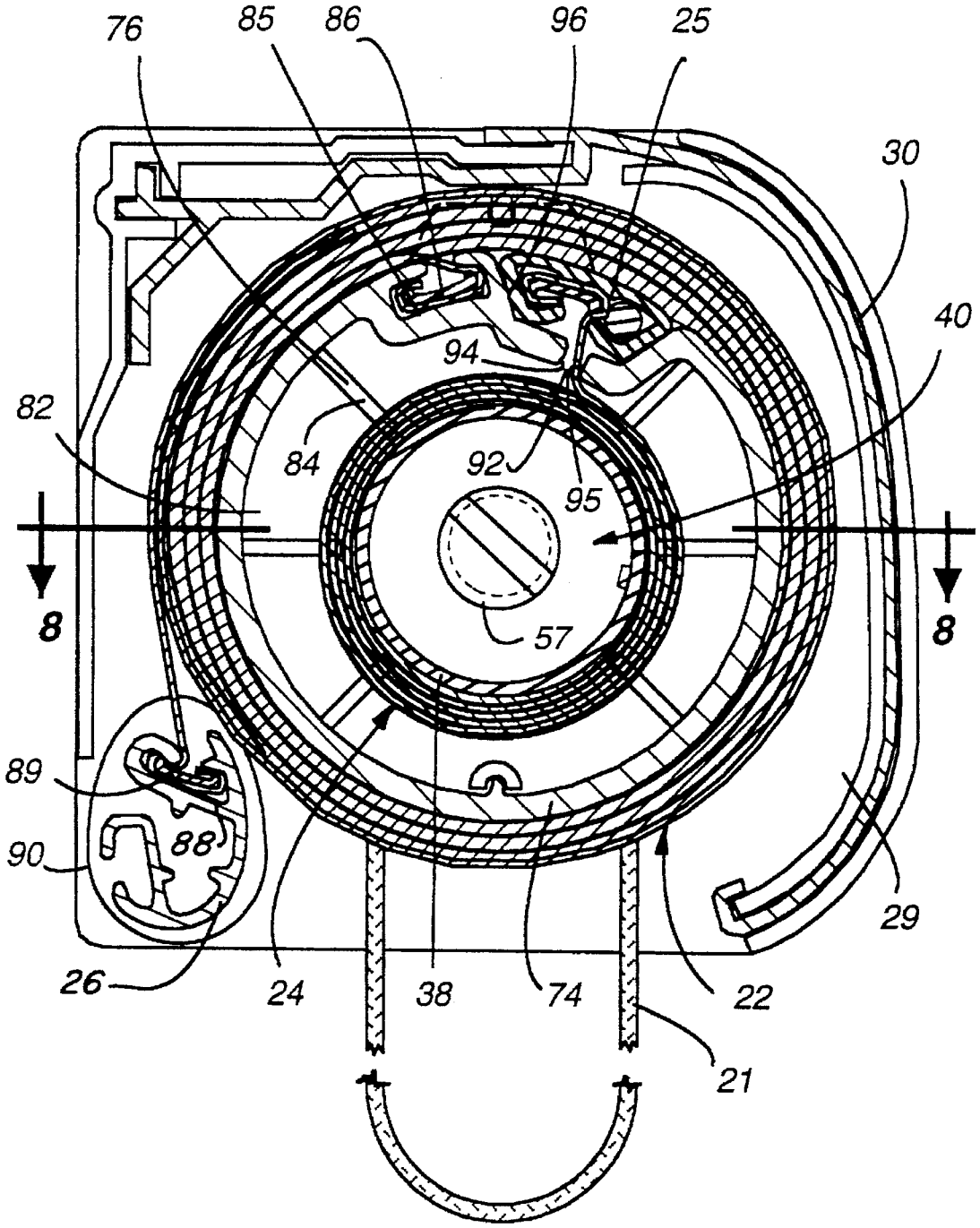
FIG. 6 is an enlarged section view taken substantially in the transverse vertical plane of line 6—6 on FIG. 2.

The outer or front shade 22 is secured along one transverse edge to the outer roller tube 74 by insertion of the edge into a slot or channel 85 extending longitudinally along the outer tube and secured thereon by an insert strip 86. At its opposite edge the shade is secured to the bottom rail 26 again by insertion of the bottom edge of the shade into a slot 88 in the bottom rail and held therein by an insert strip 89 (FIG. 6). Appropriate decorative end covers 90 may be provided for enclosing the ends of the bottom rail.

In order to raise and lower the inner or rear shade 24 when the same is surrounded by the outer tube 74, the outer roller tube 74 defines a slot 92 through which the shade 24 extends. To reduce friction on the rear shade, the edges 94 of the slot 92 are coated with an anti-friction coating 95.

For receiving and nesting the bottom rail 25 of the inner shade 24 when the inner shade is wound on the inner tube 38 thereby to couple the inner and outer tubes together, the outer tube defines a longitudinal channel 96 adjacent the slot 92 and shaped to receive the bottom rail 25 of the inner or rear shade with one edge surface thereof forming a continuation of the surface of the outer tube 74.

As the inner tube 38 is rotated to wind the inner shade thereon, the bottom rail 25 engages and nests within the outer tube channel 96. Continued rotation of the inner roller assembly 34 by the pull cord 21 then rotates the outer roller assembly to wind the outer or front shade 22 on the outer roller tube 74. The outer or front shade rolls on the outer tube 74 thereby locking the inner shade bottom rail 25 in the channel 96.

To lower the shades the direction of pull on the pull cord 21 is reversed, the tubes rotate together, being locked together, thereby unwinding and lowering the front or sheer panel 22 until it is fully extended and hanging freely from the outer tube under the tension applied by the bottom rail thereon. The bottom rail is of sufficient weight to ensure that the shade panel is lowered under the force of gravity and remains tightly extended in its lowered position.

Figure 11:
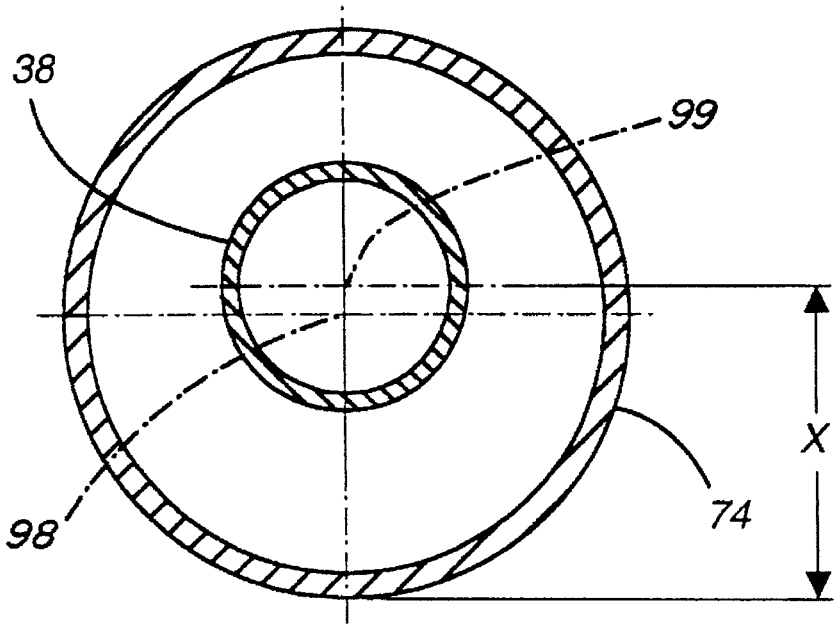
FIG. 11 is a transverse cross-sectional schematic view showing the axial relationship of the outer tube and inner tube.
Figure 12:
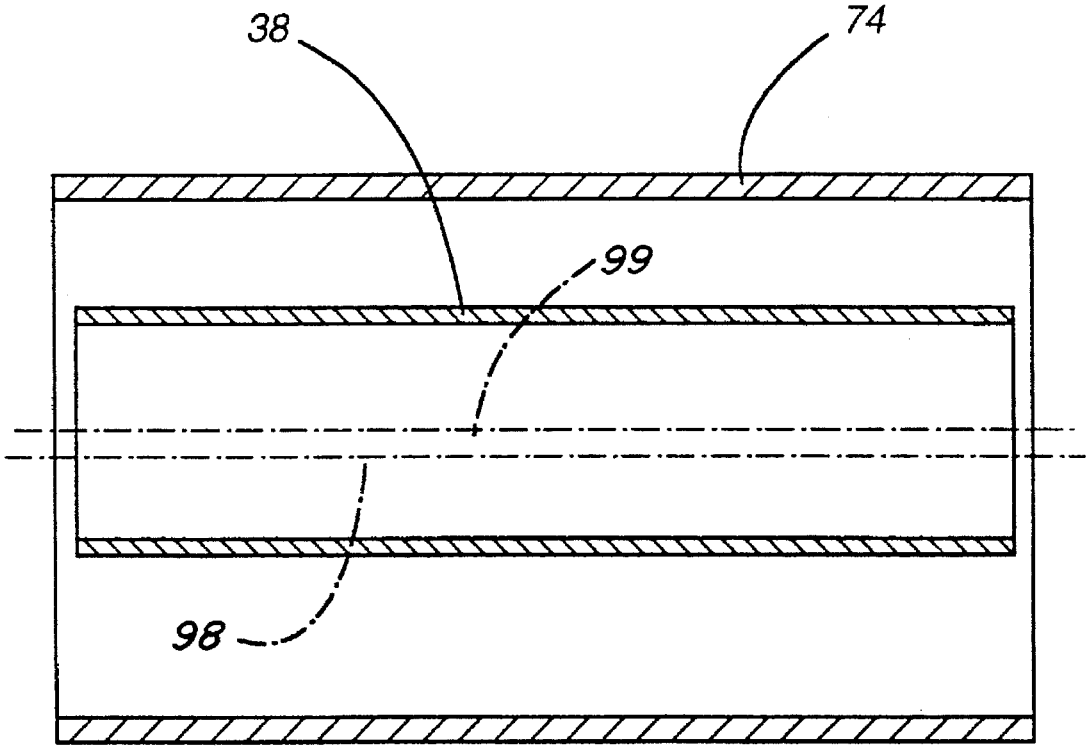
FIG. 12 is a longitudinal cross-sectional view showing the axial relationships of the outer tube and inner tube.

At its unwound lowermost point the front or outer shade hangs from the outer roller thereby releasing the inner shade rail 25 and inner shade panel for lowering or raising. To ensure that the outer roller tube is held relatively stationary by the depending shade panel and bottom rail, thereby allowing for manipulation of the inner or rear panel, the center axis 98 of the outer tube is offset from the axis of rotation 99 of the outer roller tube 74 (FIG. 11). Both the inner and outer roller tubes 38, 74 have the same axis of rotation 99, while the center axis 98 of the outer roller is offset therefrom. The axis of rotation 99 of the outer tube is on a diametrically opposite side of its center axis 98 from the point or line of attachment of the outer or front shade panel 22. This orientation creates a moment arm X which provides a resistance to winding of the outer shade until the inner shade 24 has been fully retracted and the bottom rail 25 thereof is nested in the channel 96 defined in the outer tube 74. The slightly eccentric rotation produced by the off-center axis of rotation of the outer roller tube 74 has a further advantage. When the outer roller supports a sheer, lightweight fabric panel or panel of other lightweight material, rotation of the roller slightly shakes the panel as it is rolled or unrolled to even the wrapping action and reduce wrinkles and buckles in the material.

The mounting brackets 31 for securing the shade assembly to the window frame 32 may be of any appropriate configuration. As shown in FIGS. 2 and 3, the brackets are L-shaped with one leg 100 adapted to be fastened to the window frame by appropriate mounting fasteners 101 such as screws. The other leg 102 is secured to the valance by an appropriate snap insert connection. To this end the legs extend horizontally and define an outer edge or lip 104 adapted to engage in an upper and rearwardly extending channel 105 formed on the valance 30 with the valance thereby suspended from the leg in cantilever fashion. The upper leg may likewise be screwed to the window frame by appropriate screw fasteners 101. Alternatively, any appropriate fastening and mounting structure may be utilized such as the structures conventionally used for hanging draperies, vertical blinds and the like.

Figure 9:
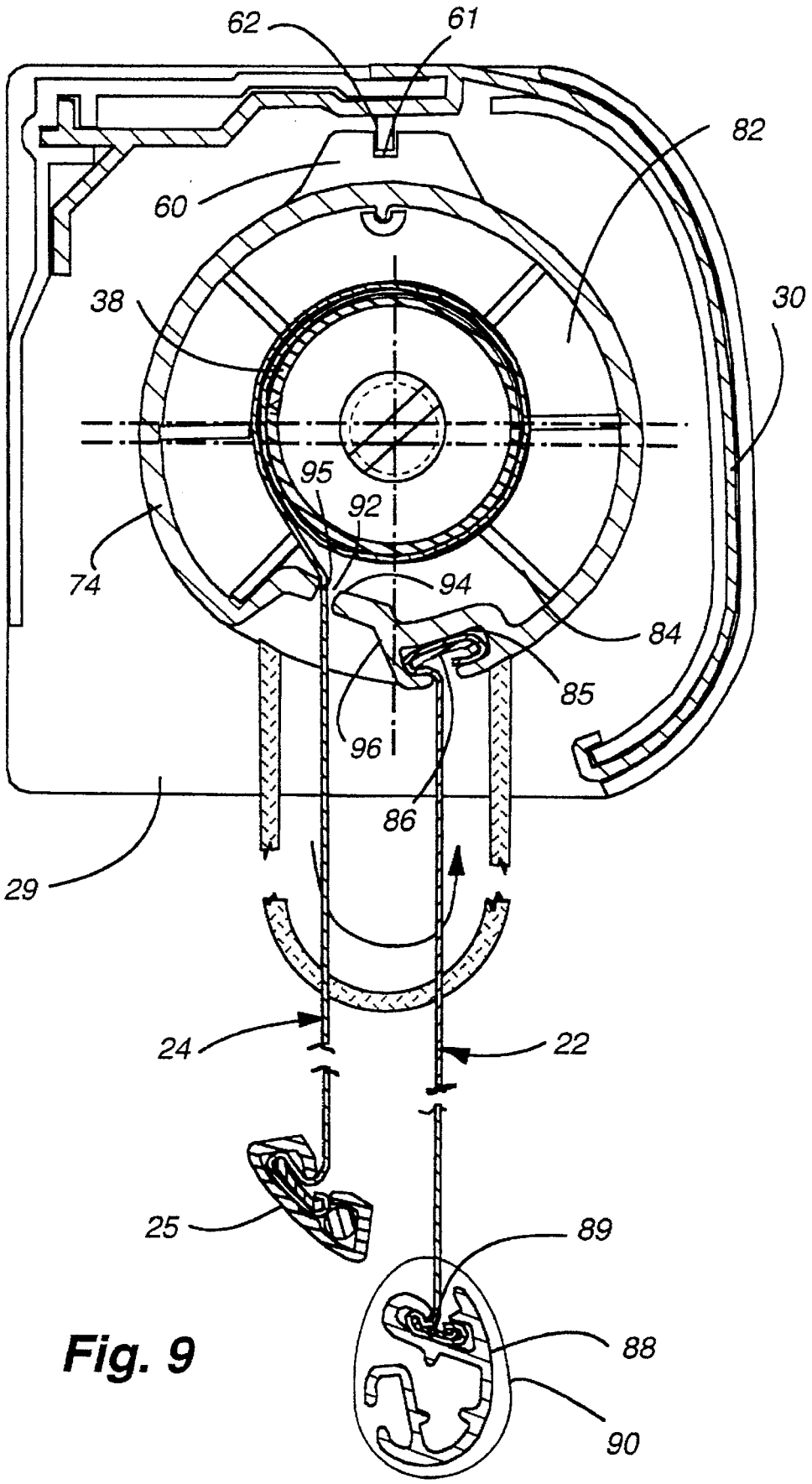
FIG. 9 is an enlarged transverse vertical section view taken substantially in the plane of line 9—9 on FIG. 1.
Figure 10:
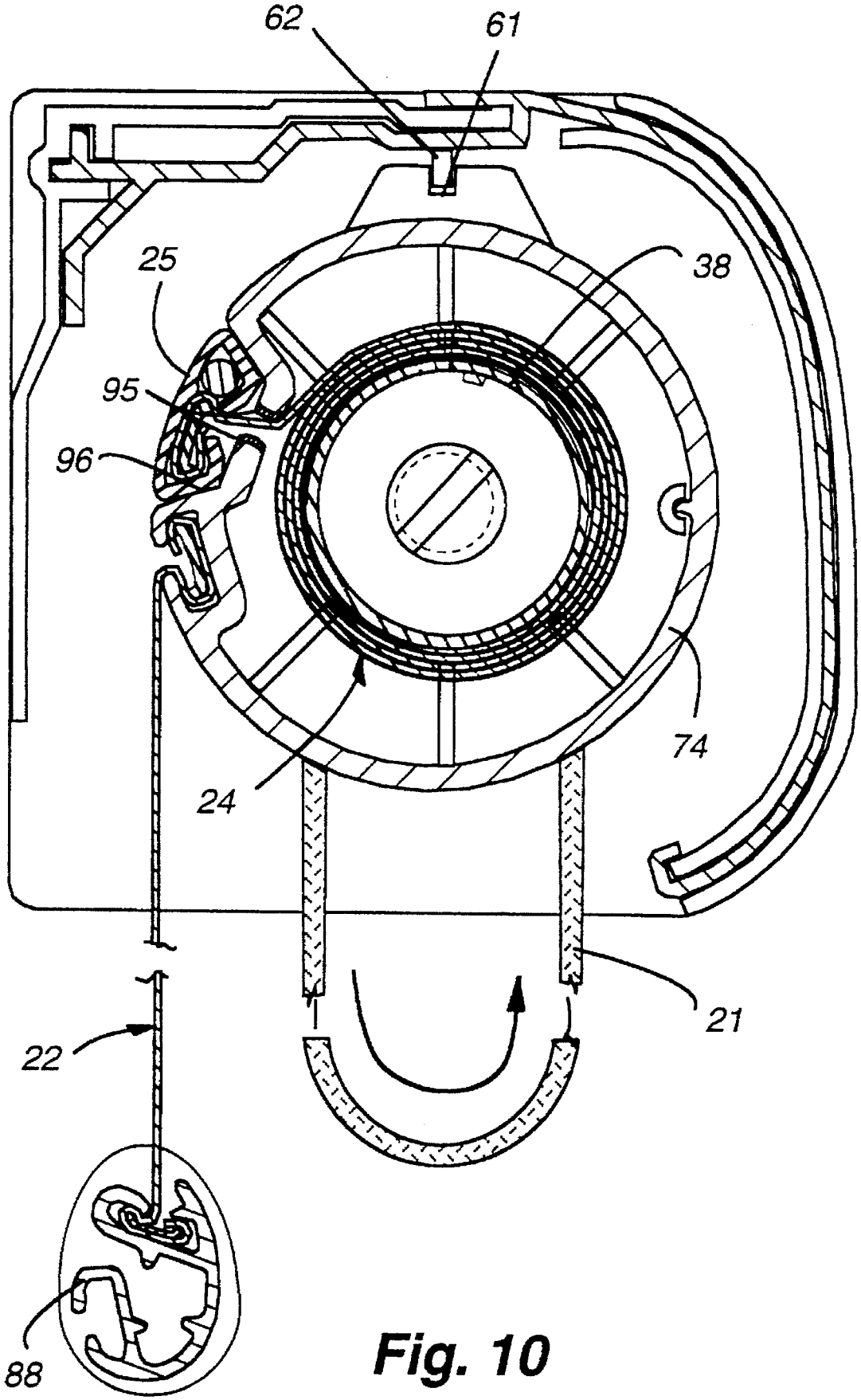
FIG. 10 is a section view similar to FIG. 9 but showing the inner shade fully wound and the outer shade partially extended.

In use, the shades are unwound and lowered by first completely lowering the outer or sheer panel (FIG. 10) following which the light and privacy control panel can be raised and lowered to a desired position (FIG. 9). The shades are retracted by first completely retracting the inner or rear light and privacy control shade following which the decorative sheer shade panel is wound on the outer roller (FIG. 6). The only control utilized is the single pull cord 21 which actuates both shade panels 22, 24 to raise and lower the same.

Although a friction clutch operated inner roller has been described, it will be apparent that other clutch and spring mechanisms may be utilized. Likewise, the panels are not limited to light control or window coverings, and may be of any desired configuration and composition. One panel may, for example, be a movie or video projection screen and the other a scrim.

While a certain illustrative embodiment of the present invention has been shown in the drawings and described above in considerable detail, it should be understood that there is no intention to limit the invention to the specific form and construction disclosed. On the contrary, the intention is to cover all modifications, alternative constructions, equivalents and uses falling with the spirit and scope of the invention as expressed in the appended claims.

We claim:

1. A double panel shade comprising an elongated outer roller having a central longitudinal axis and an elongated inner roller mounted within said outer roller having a central longitudinal axis different from said central longitudinal axis of said outer roller, a mounting system supporting said inner and outer rollers for rotative movement about said central longitudinal axis of said inner roller, an outer panel secured to and adapted to be wrapped around said outer roller and an inner panel secured to said inner roller.

2. The shade of claim 1 further comprising a pull cord for raising and lowering said panels by rotation of said rollers.

3. The shade of claim 2 wherein said pull cord is operatively connected to only one of said rollers for raising and lowering said panels by rotating said rollers.

4. The shade of claim 3 wherein said pull cord is operatively connected to said inner roller by a dual acting spring clutch for raising and lowering said panels by rotation of said inner roller.

5. The shade of claim 4 further comprising mounting brackets at each end of said rollers, said dual acting spring clutch being on one end of said inner roller and operatively connecting said inner roller to a bracket, a bearing rotatably mounting the other end of said inner roller on said bracket, and bearings at each end of said outer roller journaling said outer roller on said inner roller.

6. The shade of claim 5 wherein said inner panel is provided at a lower end with a bottom rail, and wherein said bottom rail is adapted to engage said outer roller when said inner panel is substantially wrapped around said inner roller, said engagement of said bottom rail with said outer roller providing a driving connection between said pull cord, said clutch, said inner roller, said inner panel and said outer roller for rolling said outer panel on said outer roller.

7. The shade of claim 6 wherein said outer panel is a sheer material.

8. The shade of claim 7 wherein said inner panel is a light control and privacy material.

9. A double panel shade comprising an elongated outer roller having an elongated slot therein, said outer roller being rotatable about a longitudinal axis, an elongated inner roller rotatable about a longitudinal axis, said inner roller being positioned within said outer roller, said inner roller being capable of being rotated independently of said outer roller, an outer panel secured to and rollable around said outer roller, and an inner panel extending through the slot in the outer roller and being secured to and rollable around said inner roller, said inner panel having an engagement member adapted to cooperate with said outer roller whereby substantially complete rolling of the inner shade on the inner roller allows said engagement member to engage and cause rotation of said outer roller with continued rotation of said inner roller thereby causing said outer panel to be rolled on said outer roller.

* * * * *

UNITED STATES PATENT AND TRADEMARK OFFICE

CERTIFICATE OF CORRECTION

PATENT NO. : 5,647,421

DATED : July 15, 1997

INVENTOR(S) : Brian M. Hoffmann, et al.

It is certified that error appears in the above-identified patent and that said Letters Patent is hereby corrected as shown below:

| | |
|---|---|
| Title page [54] and Col. 1, line 1 | Title should read "DUAL SHADE ASSEMBLY" |

Signed and Sealed this

Second Day of December, 1997

*Attest:*

*Attesting Officer*

BRUCE LEHMAN

*Commissioner of Patents and Trademarks*